US007287465B2

(12) United States Patent
Nojiri et al.

(10) Patent No.: US 7,287,465 B2
(45) Date of Patent: Oct. 30, 2007

(54) STENCIL PRINTING MACHINE AND CONTROL METHOD THEREOF

(75) Inventors: Masami Nojiri, Ibaraki-ken (JP); Satoshi Kouzai, Ibaraki-ken (JP); Keiji Oishi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 168 days.

(21) Appl. No.: 11/286,414

(22) Filed: Nov. 25, 2005

(65) Prior Publication Data

US 2006/0112841 A1 Jun. 1, 2006

(30) Foreign Application Priority Data

Nov. 26, 2004 (JP) ..... P2004-342530

(51) Int. Cl.
*B41L 13/00* (2006.01)

(52) U.S. Cl. ..... 101/118; 101/114; 101/129

(58) Field of Classification Search ..... 101/114, 101/118, 129
See application file for complete search history.

(56) References Cited

U.S. PATENT DOCUMENTS 6,067,902 A * 5/2000 Takahashi ..... 101/118
6,336,401 B1 * 1/2002 Hasebe ..... 101/118
6,604,460 B2 * 8/2003 Watanabe ..... 101/119
6,640,702 B2 * 11/2003 Watanabe et al. ..... 101/115

FOREIGN PATENT DOCUMENTS

JP 2001-315422 11/2001

* cited by examiner

*Primary Examiner*—Minh Chau
(74) *Attorney, Agent, or Firm*—The Nath Law Group; Jerald L. Meyer; Derek Richmond

(57) ABSTRACT

A stencil printing machine is provided with a printing drum and a second printing drum. The stencil printing machine makes first and second stencil having first and second images perforated, winds the first and second stencil sheets around the first and second printing drums respectively, and presses print sheets on the first and second printing drums. The stencil printing machine includes a controller for performing a printing operation of firstly allowing the first printing drum to print the first printed sheets by a required number per one class and subsequently allowing either the second printing drum only or the first and second printing drums to print a single second printed sheet or the required number of second printed sheets. This printing operation is carried out by the controller, with respect to each class.

5 Claims, 8 Drawing Sheets

| GROUP NO. | QTY. OF PRINTS /CLASS (X) | CLASSES (M) |
|---|---|---|
| GROUP #1 | 20 PICS. | 5 CLASSES |
| GROUP #2 | 50 PICS. | 10 CLASSES |
| GROUP #3 | 15 PICS. | 3 CLASSES |
| GROUP #4 | 0 PIECE | 0 CLASS |
| GROUP #5 | 0 PIECE | 0 CLASS |
| . . . | . . . | . . . |
| GROUP #50 | 0 PIECE | 0 |

STENCIL PRINTING MACHINE AND CONTROL METHOD THEREOF

BACKGROUND OF THE INVENTION

1. Field of the Invention

The present invention relates to a stencil printing machine having a plurality of printing drums and a method of controlling the stencil printing machine, and more particular, a technique for allowing a plural kinds of printed sheets to be collectively printed with respect to each group.

2. Description of the Related Art

Japanese Patent Application Laid-Open No. 2001-315422 discloses a stencil printing machine having two printing drums that can be accomplished by allocating different color inks for the respective printing drums. Additionally, the stencil printing machine is provided with a so-called "group-printing" function of printing printed sheets by required numbers with respect to each specific group, for example, school years and school classes.

SUMMARY OF THE INVENTION

However, the group-printing function realizes collectively printing a single kind of printed sheets with respect to each group. In other words, the stencil printing machine is not constructed so as to collectively print two kinds of printed sheets (e.g. printed sheets for pupils and printed sheet for teachers) with respect to each group. Consequently, if it is required to print two kinds of printed sheets in group unit together, a user has to individually print two kinds of printed sheets by a required quantity each and further sort the two kinds of printed in group unit by hand, requiring much work and time.

In order to achieve the above issue, the present invention has a aim to provide a stencil printing machine capable of group-printing a plural kinds of printed sheets in group unit collectively and a method of controlling the stencil printing machine.

According to a first aspect of the present invention, there is provided a stencil printing machine having first and second printing drums, which makes first and second stencil sheets based on original images, winds the first and second stencil sheets around the first and second printing drums respectively, and presses print sheets on the first and second printing drums to print the original images onto the print sheets, the stencil printing machine comprising: an operator for allowing a user to input a first number of print sheets consisting of first printed sheets and a second number of print sheets consisting of second printed sheets with respect to each group; a group-printing setting information storage unit for storing the first number of print sheets and the second number of print sheets with respect to each group inputted by the operator; and a controller configured to control an operation of the stencil printing machine so as to perform a printing operation of firstly allowing the first printing drum to print the first printed sheets by the first number of print sheets stored in the group-printing setting information storage unit and subsequently allowing either the second printing drum only or the first and second printing drums to print the second printed sheets by the second number of print sheets stored in the group-printing setting information storage unit, wherein the printing operation is carried out with respect to each group.

According to a second aspect of the invention, there is provided a method of controlling a stencil printing machine having first and second printing drums, which makes first and second stencil sheets based on original images, winds the first and second stencil sheets around the first and second printing drums respectively, and presses print sheets on the first and second printing drums to print the original images onto the print sheets, the method comprising the steps of: storing a first number of print sheets consisting of first printed sheets and a second number consisting of second printed sheets with respect to each group; performing a printing operation of firstly allowing the first printing drum to print the first printed sheets by the first number of print sheets and subsequently allowing either the second printing drum only or the first and second printing drums to print the second printed sheets by the second number of print sheets wherein the printing operation is carried out with respect to each group.

According to a third aspect of the present invention, there is provided a stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising: an operator for allowing a user to input a first number of print sheets to a k-th number of print sheets, each of which corresponds to k kinds of printed sheets included in a given printing pattern of $$\prod_{i=2}^{k}\left(\sum_{j=0}^{i-1} {}_{i-1}C_j\right)$$

kinds of printing patterns with respect to each group; a group-printing setting information storage unit for storing the first number of print sheets to the k-th number of print sheets with respect to each group inputted by the operator; and a controller for controlling printing drums, that are required to generate the given printing pattern, of the k numbers of printing drums, and printing the k kinds of printed sheets included in the given printing pattern by the first number of print sheets to the k-th number of print sheets stored in the group printing setting information storage unit, wherein the printing operation is carried out with respect to each group.

According to a fourth aspect of the present invention, there is provided a method of controlling a stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising: allowing the user to input a first number of print sheets to a k-th number of print sheets, each of which corresponds to k kinds of printed sheets included in a given printing pattern of $$\prod_{i=2}^{k}\left(\sum_{j=0}^{i-1} {}_{i-1}C_j\right)$$

kinds of printing patterns, with respect to each group; storing the first number of print sheets to the k-th number of print sheets with respect to each group inputted by the operator; controlling printing drums, that are required to generate the given printing pattern, of the k numbers of printing drums; and printing the k kinds of printed sheets included in the given printing pattern by the first number of print sheets to the k-th number of print sheets, wherein the printing operation is carried out with respect to each group.

According to a fifth aspect of the present invention, there is provided a stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising: an operator for providing a user with $$\prod_{i=2}^{k}\left(\sum_{j=0}^{i-1} {}_{i-1}C_j\right)$$

numbers of printing patterns, each including k numbers of printed sheets, allowing the user to select a printing pattern from among the $$\prod_{i=2}^{k}\left(\sum_{j=0}^{i-1} {}_{i-1}C_j\right)$$

numbers of printing patterns, and allowing the user to input a printing setting information about k numbers of printed sheets included in the selected printing pattern with respect to each group; a group-printing setting information storage unit for storing the printing setting information with respect to each group inputted by the operator; and a controller for controlling printing drums, that are required to generate the selected printing pattern, of the k numbers of printing drums, and printing the k numbers of printed sheets included in the selected printing pattern by a number of print sheets stored in the group-printing setting information storage unit, wherein the printing operation is carried out with respect to each group.

According to the sixth aspect of the present invention, there is provided a method of controlling a stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising: providing a user with $$\prod_{i=2}^{k}\left(\sum_{j=0}^{i-1} {}_{i-1}C_j\right)$$

numbers of printing patterns, each including k numbers of printed sheets; allowing the user to select a printing pattern from among the $$\prod_{i=2}^{k}\left(\sum_{j=0}^{i-1} {}_{i-1}C_j\right)$$

numbers of printing patterns; allowing the user to input a printing setting information about k numbers of printed sheets included in the selected printing pattern with respect to each group; storing the printing setting information with respect to each group inputted by the operator; controlling printing drums, that are required to generate the selected printing pattern, of the k numbers of printing drums; and printing the k numbers of printed sheets included in the selected printing pattern by a number of print sheets, wherein the printing operation is carried out with respect to each group.

DETAILED DESCRIPTION OF THE PREFERRED EMBODIMENT

Figure 1:
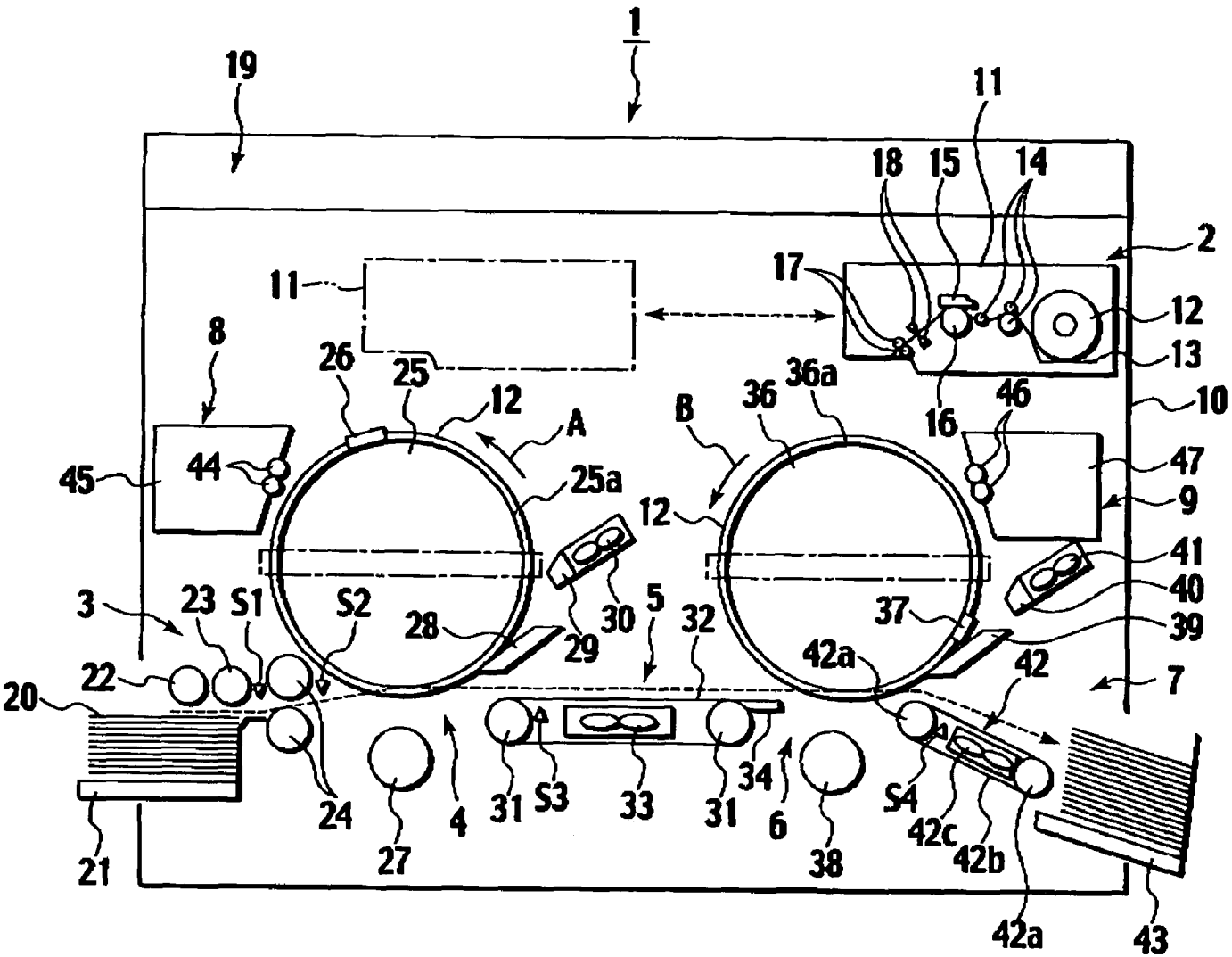
FIG. 1 is a typical view showing a constitution of a stencil printing machine according to an embodiment of the present invention.

The present invention is applicable to a stencil printing machine equipped with k numbers of printing drums, and enables the k numbers of printing drums to create $$\prod_{i=2}^{k}\left(\sum_{j=0}^{i-1} {}_{i-1}C_j\right) \tag{1}$$

kinds of printing patterns, each of which includes k kinds of printed sheets. Further, this invention allows the stencil printing machine to print the k kinds numbers of printed sheets included in a given printing pattern of the $$\prod_{i=2}^{k}\left(\sum_{j=0}^{i-1} {}_{i-1}C_j\right)$$

kinds of printing patterns with respect to each group. This invention enables the "k" to take any natural number equal or more than 2, however for simplicity the constitution and operation of a stencil printing machine having two printing drums according to an embodiment of the present invention will be described below, with reference to drawings.

[Constitution of Stencil Printing Machine]

The stencil printing machine 1 of the embodiment comprises an original read-out unit 19, a stencil maker 2, a paper feeder 3, a first printer 4, an intermediate transporter 5, a second printer 6, a sheet discharger 7, a first stencil discharger 8 and a second stencil discharger 9.

The original read-out unit 19 is arranged in an upper part of a machine body 10 to read out an original (manuscript) supplied for printing, in the form of image data. This read-out image data is realized in the form of a stencil data for a color ink (first color ink) of a first printing drum 25 and a stencil data for a color ink (second color ink) of a second printing drum 36. These stencil data can be processed on the basis of user's designated commands, for example, scaling (enlargement and scaling down).

The stencil maker 2 includes a stencil maker 11 movable in a horizontal direction in the machine body 10. Due to not-shown moving means, the stencil maker 11 can move between a first stencil supply position (i.e. position of an imaginary line of FIG. 1) for supplying the first printing drum 25 with a first stencil sheet 12 and a second stencil supply position (i.e. position of a solid line of FIG. 1) for supplying the second printing drum 36 with a second stencil sheet 12. The stencil maker 11 includes a stencil accommodating unit 13 for accommodating a long stencil sheet (roll) 12, a plurality of conveyer rolls 14 for guiding the long stencil sheet 12 accommodated in the stencil accommodating unit 13 to a downstream side of conveyance, a thermal head 15 arranged, on the "conveyance" downstream side of the conveyer rolls 14, above a carrying surface of the long stencil sheet 12, a platen roll 16 arranged at an opposite position to the thermal head 15 and rotated by driving force of a light pulse motor (not shown), a pair of stencil feed rolls 17, 17 arranged on the conveyance downstream side of the platen roll 16 and the thermal head 15 and rotated by driving force of a light pulse motor (also not shown) and a stencil cutter 18 arranged between the stencil feed rolls 17, 17 in pairs and the platen roll 16 (or the thermal head 15).

The paper feeder 3 includes a paper feed tray 21 on which print papers 20 as print mediums are stacked, first paper feed rolls 22, 23 separating an uppermost print paper 20 from the paper feed table tray 21 and transferring the print paper 20 to a downstream side of conveyance of the papers 20 and a pair of second paper feed rolls 24, 24 for feeding the print paper 20 transferred by the first paper feed rolls 22, 23 between the first printing drum 25 and a first press roll 27 in synchronous with later-mentioned rotation of the first printing drum 25. Rotations of a main motor (not shown) are selectively transmitted to the first paper feed rolls 22, 23 and the second paper feed rolls 24, 24 in pairs through respective paper feed clutches (not shown).

The paper feeder 3 is provided with a paper sensor S1 for detecting a print paper 20 in a paper transfer route between the first paper feed rolls 22, 23 and the second paper feed rolls 24, 24 and a second paper feed sensor S2 for detecting a print paper 20 in a paper transfer route between the second paper feed rolls 24, 24 and the first printing drum 25. The paper sensor S1 is provided to detect whether the print paper 20 is being transferred by the first paper feed rolls 22, 23. The second paper feed sensor S2 is provided to detect whether the print paper 20 is being transferred by the second paper feed rolls 24, 24.

The first printer 4 includes the first printing drum 25 rotated by the main motor (not shown) in a direction A of FIG. 1, a first clamp portion 26 provided on an outer circumferential wall 25*a* of the first printing drum 25 to clamp a front edge of the first stencil sheet 12, first ink supply means (not shown) arranged in the first printing drum 25 to supply an interior side of the outer circumferential wall 25*a* with first color ink through a squeegee roll (not shown) and a first press roll 27 (as a press member) arranged outside the outer circumferential wall 25*a* of the first printing drum 25 and in a position opposing to the squeegee roll (not shown). Note that the outer circumferential wall 25*a* of the first printing drum 25 is cylindrically shaped by an ink permeable member having a porous structure.

By a first press-roll moving mechanism (not shown), the first press roll 27 is formed so as to be movable between a press position where the first press roll 27 is pressed on the outer circumferential wall 25*a* of the first printing drum 25 and a withdrawal position where the first press roll 27 is apart from the outer circumferential wall 25*a* sufficiently. When a printing operation is not carried out, the first press roll 27 is positioned in the withdrawal position. During the printing operation, the first press roll 27 is controlled so as to escape into a slight estrangement position apart from the outer circumferential wall 25*a* of the first printing drum 25 within a moving range of the first press roll 27 interfering with the first clamp portion 26. Out of the moving range interfering with the first clamp portion 26, the first press roll 27 is controlled so as to approach the above-press position.

The first printer 4 further includes a separation claw 28 and a separation nozzle 29 arranged in the vicinity of the first printing drum 25 on its downstream side of conveyance of the papers 20. In operation, the separation claw 28 is inserted between the outer circumferential surface of the first printing drum 25 and the front edge of the print paper 20 transferred while being stuck to the outer circumferential surface of the first printing drum 25. Then, the separation claw 28 forcibly tears the print paper 20, which is going in for rotating on the outer circumferential surface of the first printing drum 25, away from it. The separation nozzle 28 is equipped, at its leading end, with an air nozzle (not shown) for ejecting air compressed by a first separation pump (not shown) at a separation timing of the print papers 20. Due to this "edge-separation" air ejected from the air nozzle, only the front edge of the print paper 20 stuck to the first printing drum 25 is peeled from the outer circumferential surface of the drum 25. Separation air produced by a separation fan 30 is sprayed between the outer circumferential surface of the first printing drum 25 and the print paper 20 transferred and stuck to the first printing drum 25. During rotation of the first printing drum 25, the separation fan 30 is always driven to peel the whole print paper 20, of which front edge has been peeled by the above edge-separation air ejected from the air nozzle provided in the separation claw 28, off the outer circumferential surface of the first printing drum 25.

The first printer 4 clamps the front edge of a first stencil sheet 12 transferred from the stencil maker 2 through the first clamp portion 26. Under this condition, the first printing drum 25 is rotated to wind the first stencil sheet 12 on the outer circumferential surface 25*a* of the first printing drum 25. When the first press roll 27 presses a print paper 20 transferred in synchronous with rotation of the first printing drum 25 against the first stencil sheet 12, ink is transferred to the print paper 20 through pores in the first stencil sheet 12, accomplishing to print an image of a first color ink.

The intermediate transporter 5 includes a pair of belt pulleys 31, 31 arranged between on the "conveyance" downstream side of the first printing drum 25 and on the "conveyance" upstream side of the second printing drum 36 mentioned later in detail, an endless belt 32 hooked on the belt pulleys 31, 31, a suction fan 33 for sucking a print paper 20 toward a paper transporting surface of the endless belt 33 and belt driving means (not shown) for moving the endless belt 32. In operation, the intermediate transporter 5 receives the print paper 20 peeled off the first printing drum 25 and subsequently supplies the print paper 20 between the second printing drum 36 and a second press roll 38 in synchronous with the rotation of the second printing drum 36.

The intermediate transporter 5 is provided with an intermediate sensor S3. The intermediate sensor S3 is provided to detect whether the print paper 20 has been brought after being separated from the first printer 4.

The second printer 6 has a cylindrical outer circumferential wall 36*a*, having an identical constitution to that of the first printer 4. The second printer 6 includes the second printing drum 36 rotating in a direction of arrow B of FIG. 1 by driving force of the main motor (not shown), a second clamp portion 37 provided on the outer circumferential wall 36*a* of the second printing drum 36 to clamp a front edge of a second stencil sheet 12, second ink supply means (not shown) arranged in the second printing drum 36 to supply an interior side of the outer circumferential wall 36*a* with second ink through a squeegee roll (not shown) and the second press roll 38 (as a press member) arranged outside the outer circumferential wall 36*a* of the second printing drum 36 and in a position opposing to the squeegee roll (not shown). The constitution of the second press roll 38 is similar to that of the first press roll 27 and therefore, an explanation of the second press roll 38 is eliminated.

The second printer 6 further includes a separation claw 39 and a separation nozzle 40 arranged in the vicinity of the second printing drum 36 on the downstream side of conveyance of the papers 20. In operation, the separation claw 39 is inserted between the outer circumferential surface of the second printing drum 36 and the front edge of the print paper 20 transferred while being stuck to the outer circumferential surface of the second printing drum 36. Then, the separation claw 39 forcibly tears the print paper 20, which is going in for rotating on the outer circumferential surface of the second printing drum 36, away from it. The separation nozzle 39 is equipped, at its leading end, with an air nozzle (not shown) for ejecting air compressed by a second separation pump (not shown) at a separation timing of the print papers 20. Due to this "edge-separation" air ejected from the air nozzle, only the front edge of the print paper 20 stuck to the second printing drum 36 is peeled from the outer circumferential surface of the drum 36. Separation air produced by a separation fan 41 is sprayed between the outer circumferential surface of the second printing drum 36 and the print paper 20 transferred and stuck to the second printing drum 36. During rotation of the second printing drum 36, the separation fan 41 is always driven to peel the whole print paper 20, of which front edge has been peeled by the above edge-separation air ejected from the air nozzle provided in the separation claw 39, off the outer circumferential surface of the second printing drum 36.

The second printer 6 clamps the front edge of the second stencil sheet 12 transferred from the stencil maker 2 through the second clamp portion 37. Under this condition, the second printing drum 36 is rotated to wind the second stencil sheet 12 on the outer circumferential surface 36*a* of the second printing drum 36. When the second press roll 38 presses the print paper 20 transferred in synchronous with rotation of the second printing drum 36 against the second stencil sheet 12, ink is transferred to the print paper 20 through the pores in the second stencil sheet 12, accomplishing to print an image of a second color.

The sheet discharger 7 includes a belt conveyer mechanism 42 for transporting the print paper 20 peeled off the second printing drum 36 and a paper receiving tray 43 for mounting the print paper 20 discharged from the belt conveyer mechanism 42. The belt conveyer mechanism 42 comprises a pair of pulleys 42*a*, 42*a*, an endless belt 42*b* hooked on the belt pulleys 42*a*, 42*a*, a suction fan 42*c* for sucking a print paper 20 toward a paper transporting surface of the endless belt 42*b* and belt driving means (not shown) for moving the endless belt 42*b*. In operation, the belt conveyer mechanism 42 transports the print paper 20 separated from the second printing drum 36 up to the paper receiving tray 43 and successively mounts the print paper 20 on the tray 43. Additionally, the belt conveyer mechanism 42 is provided with a paper receiving sensor S4. The paper receiving sensor S4 is provided to detect whether a print paper 20 has been transferred from the second printer 6 or not.

The first stencil discharger 8 includes a pair of stencil discharge rolls 44, 44 for peeling the first stencil sheet 12, whose front edge has been released from its clamped condition, off the first printing drum 25 and transporting the first stencil sheet 12, and a stencil discharge box 45 for accommodating the first stencil sheet 12 transferred by the stencil discharge rolls 44, 44.

The second stencil discharger 9 includes a pair of stencil discharge rolls 46, 46 for peeling the second stencil sheet 12, whose front edge has been released from its clamped condition, off the second printing drum 36 and transporting the second stencil sheet 12, and a stencil discharge box 47 for accommodating the second stencil sheet 12 transferred by the stencil discharge rolls 46, 46.

Next, the stencil making operation and printing control operation of the above stencil printing machine 1 at bicolor printing will be described.

When a bicolor stencil making mode is selected, stencil making and disposal processes for the first printing drum 25 are carried on. First of all, a controller (not shown) checks whether a spent first stencil sheet 12 is being wound around the first printing drum 25 or not. If the spent first stencil sheet 12 is wound around the first printing drum 25, it is performed to remove the spent first stencil sheet 12 from the first printing drum 25 and continuously dispose of the spent first stencil sheet 12 into the stencil discharge box 45.

After the stencil discharge process is completed, a new first stencil sheet 12 is thermo-sensitively perforated by the thermal head 15 on the ground of the first color ink stencil data read out by the original read-out unit 19. Then, under condition that the first clamp portion 26 clamps the front edge of the accomplished first stencil sheet 12, the first printing drum 25 is rotated to wrap the first stencil sheet 12 on the outer circumferential wall 25*a* of the first printing drum 25, accomplishing a stencil fixing process. After this stencil fixing process for the first printing drum 25, another stencil making-and-discharge operation for the second printing drum 36 is started. First, by the stencil-maker moving means (not shown), the stencil maker 11 is transferred from the first stencil supply position on the side of the first printing drum 25 to the second stencil supply position on the side of the second printing drum 36. Next, the controller (not shown) judges whether a spent second stencil sheet 12 is being wound around the second printing drum 36. If the second printing drum 36 is equipped with the spent second stencil sheet 12, it is removed from the second printing drum 36 and successively disposed into the stencil discharge box 47. Based on stencil data corresponding to the second color ink obtained, a new second stencil sheet 12 is thermosensitively perforated by the thermal head 15. Similarly to the first printing drum 25, another stencil fixing process where the accomplished second stencil sheet 12 is wrapped on the second printing drum 36 is carried out, completing the stencil making operation for the second printing drum 36.

Next, when a bicolor printing mode is selected, the main motor (not shown) drives to rotate the first and second printing drums 25, 36, a print paper 20 is transferred from the paper feeder 3 to the first printing drum 25 in synchronous with the rotations of the first and second printing drums 25, 36. Subsequently, when the print paper 20 on supply is pressed on the first stencil sheet 12 on the first printing drum 25 by the first press roll 27, the image of the first color ink is printed on the print paper 20. Then, due to the separation claw 28, the edge separation air and the separation air, the print paper 20 having the image of the first color ink printed thereon is peeled off the outer circumferential surface of the first printing drum 25 and further introduced to the intermediate transporter 5. At the intermediate transporter 5, the print paper 20 is transported by the endless belt 32 and transferred to the second printing drum 36. Subsequently, when the print paper 20 on supply is pressed on the second stencil sheet 12 on the second printing drum 36 by the second press roll 38, the image of the second color ink is printed on the print paper 20. Then, due to the separation claw 28, the edge separation air and the separation air, the print paper 20 having the image of the second color ink printed thereon is peeled off the outer circumferential surface of the second printing drum 36 and further introduced to the belt conveyer mechanism 42. At the belt conveyer mechanism 42, the print paper 20 is transported by the endless belt 42*b* and discharged from the undermost part of the mechanism 42 to the paper receiving tray 43. The discharged print paper 20 is mounted on the paper receiving tray 43 so as to pile on another print paper.

Meanwhile, if any one of the paper sensor S1, the second paper feed sensor S2, the intermediate sensor S3 and the paper receiving sensor S4 does not detect the print papers 20 each passing through the sensor at its designated timing, it is judged that a jamming has occurred. When it is judged that the jamming of the print paper 20 has occurred, respective solenoids (not shown) for the first and second pressing operations are turned off to bring the first and second press rolls 27, 38 into their withdrawal positions while keeping on rotating the first printing drum 25 and the second printing drum 36 and further driving respective driving systems for the paper feeder 3, the intermediate transporter 5 and the sheet discharger 7 by only a predetermined time. If the jamming of the print paper 20 is cancelled within a predetermined period for any reason since an occurrence of the jamming, the print paper 20 on cancellation of the jamming is discharged without being subject to a printing process.

Regarding this passage of such a jammed print paper 20 between the second printing drum 36 and the second press roll 38, the print paper 20 can pass without making contact with the second printing drum 36 since the second press roll 38 is positioned in the withdrawal position sufficiently apart from the outer circumferential wall 36*a* of the second printing drum 36. That is, since the jammed print paper 20 passes between the second printing drum 36 and the second press roll 38 without making contact with the outer circumferential surface of the second printing drum 36, it is possible to prevent the first and second so stencil sheets 12, 12 from being contaminated by ink, certainly.

Next, an operation that printing is performed by not the second printing drum 36 but only the first printing drum 25 will be described.

In this case, when a print paper 20 passes through the vicinity of the second printing drum 36, the second press roll 38 is positioned in the withdrawal position. Therefore, the print paper 20 passes without making contact with the outer circumferential surface of the second printing drum 36 and is transferred to the sheet discharger 7. In this case, it is preferable that the separation fan 41 is controlled so as not to exhale the separation air.

Next, another situation that the printing is performed by not the first printing drum 25 but only the second printing drum 36 will be described. In this case, when a print paper 20 transferred from the paper feeder 3 by the first paper feed rolls 22, 23 and the second paper feed rolls 24, 24 passes through the vicinity of the first printing drum 25, the first press roll 27 is positioned in the withdrawal position. Therefore, the print paper 20 passes without making contact with the outer circumferential surface of the first printing drum 25 and is transferred to the intermediate transporter 5. In this case, it is preferable that the separation fan 30 is controlled so as not to exhale the separation air.

[Structure of Control System]

Figure 2:
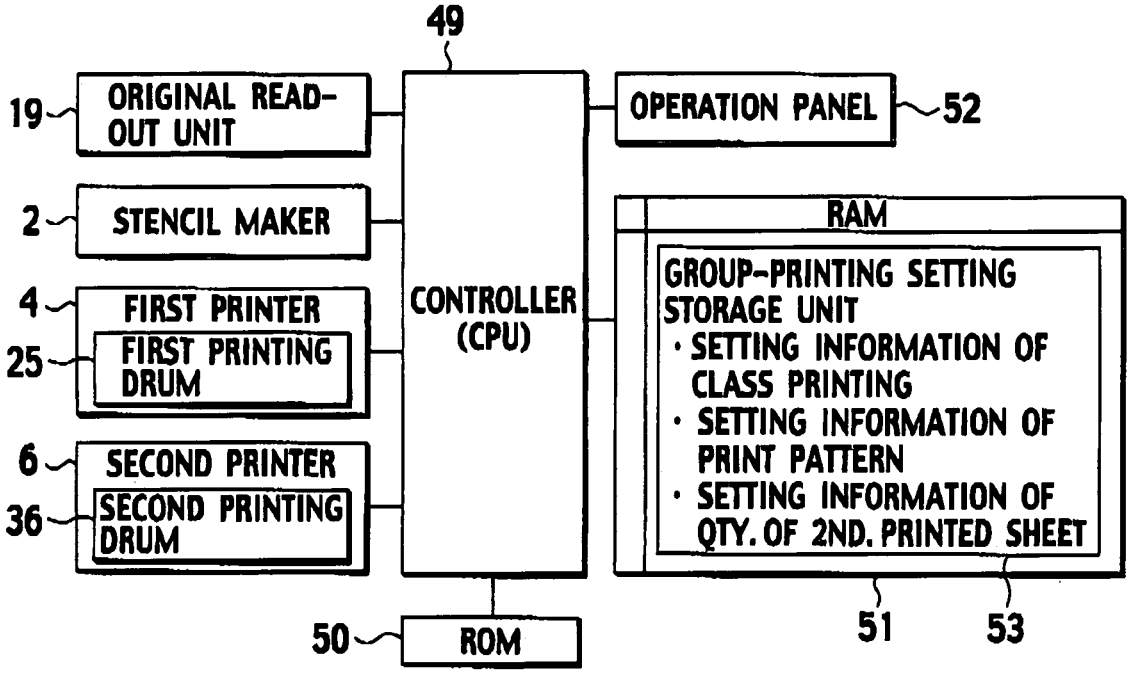
FIG. 2 is a block diagram showing a constitution of a control system of the stencil printing machine of FIG. 1.

In a control system of the stencil printing machine 1, as shown in FIG. 2, a controller 49 controls respective operations of the original read-out unit 19, the stencil maker 2, the first printer 4 and the second printer 6 in accordance with control programs (not shown) stored in a ROM 50, corresponding to various operative information inputted by a user operating an operation panel 52. With this operation of the controller 49, the control system of the stencil printing machine 1 is constructed so as to perform a stencil printing process for the image data of an original read out by the original read-out unit 19. Again, this control system has a RAM 51 functioning as a working area of the controller 49 in performing various control operations. The RAM 51 includes a group-printing setting storage unit 53 for memorizing a class-printing setting information, a print-pattern setting information and a quantity (Qty.) setting information about second printed sheets, all of which are produced by a group-print setting operation described later.

Note that the operation panel 52 is provided with a stencil key (not shown) for starting the stencil making operation, a print key (not shown) for starting the printing operation, a stop key (not shown) for stopping the printing operation, numeric keys (not shown) for inputting the quantity of prints to be printed, prints-quantity display means (not shown) formed by 7-segment LED (Light Emitting Diode) etc. to display the quantity of prints to be printed, a liquid crystal touch panel (not shown) for setting and displaying various functions and so on.

In the above-constructed stencil printing machine 1, the controller 49 controls an operation of the machine 1 so as to perform a group printing in accordance with combination and quantity of printed sheets designated through the operation panel 52 by a user, with the use of the first and second printing drums 25, 36 equipped with the first and second stencil sheets 12, 12 perforated on the basis of the first and second image data. The operation of the controller 49 in performing the group printing will be described in detail, with reference to a flow chart of FIG. 3.

[Group Printing]

Figure 3:
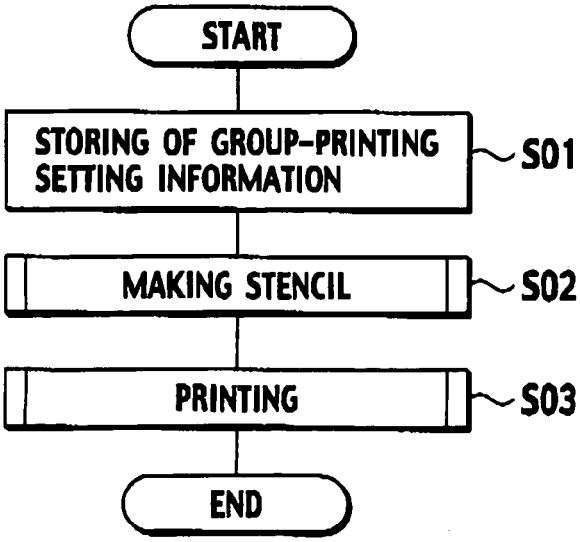
FIG. 3 is a flow chart showing an operating procedure of a group printing operation of the embodiment of the present invention.

The flow chart of FIG. 3 is carried out at the point of completing an initialization of the stencil printing machine 1 after applying power to it.

Figure 4:
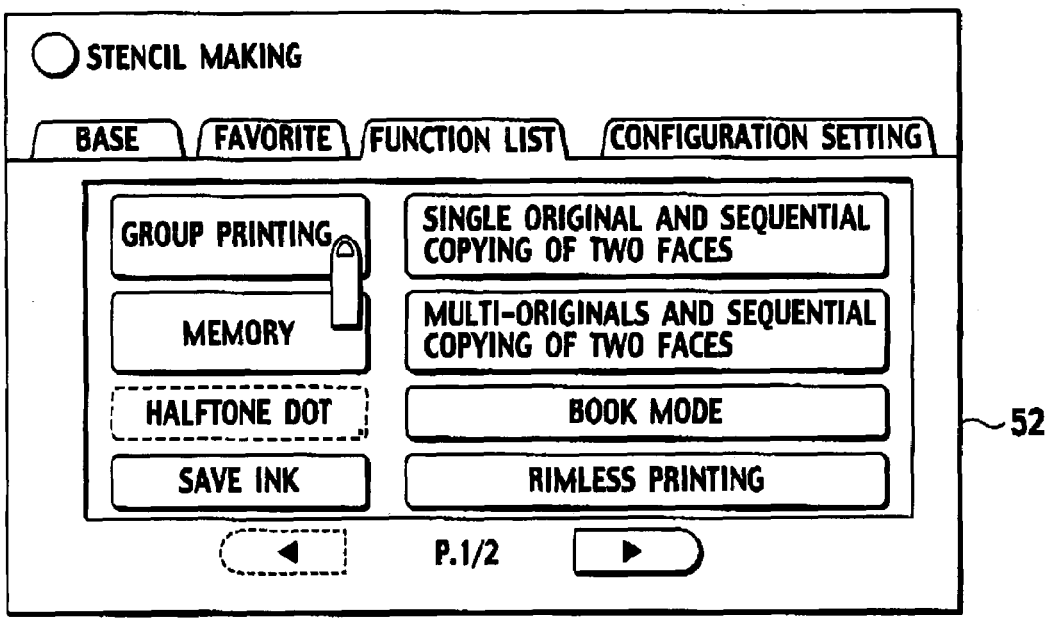
FIG. 4 is a typical view showing a constitution of a group printing selecting screen of the embodiment of the present invention.

In step S01, if a user opens a tab "function list" in a screen displayed on the liquid crystal touch panel (not shown) of the operation panel 52 and selects an item "group printing" (see FIG. 4), then the controller 49 displays a setting screen for group printing (see FIG. 5) on the liquid crystal touch panel of the operation panel 52, corresponding to the selection of "group printing". Then, with a user's execution of setting the group printing while using the setting screen, the controller 49 stores established information in the group-printing setting storage unit 53 and thereafter, the routine goes to step S02.

Figure 5:
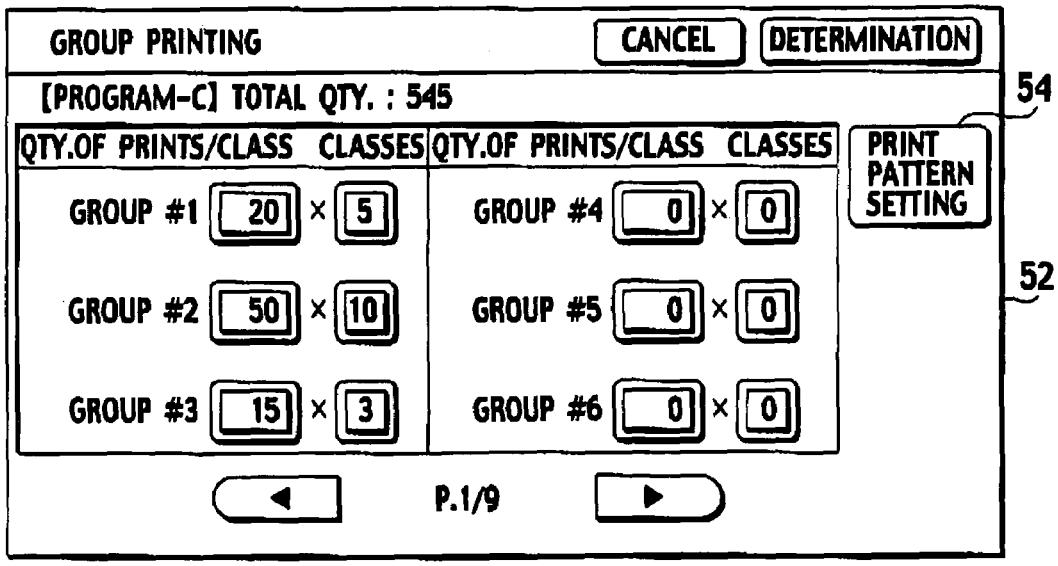
FIG. 5 is a typical view showing a constitution of a group printing setting screen of the embodiment of the present invention.
Figures 6, 7:
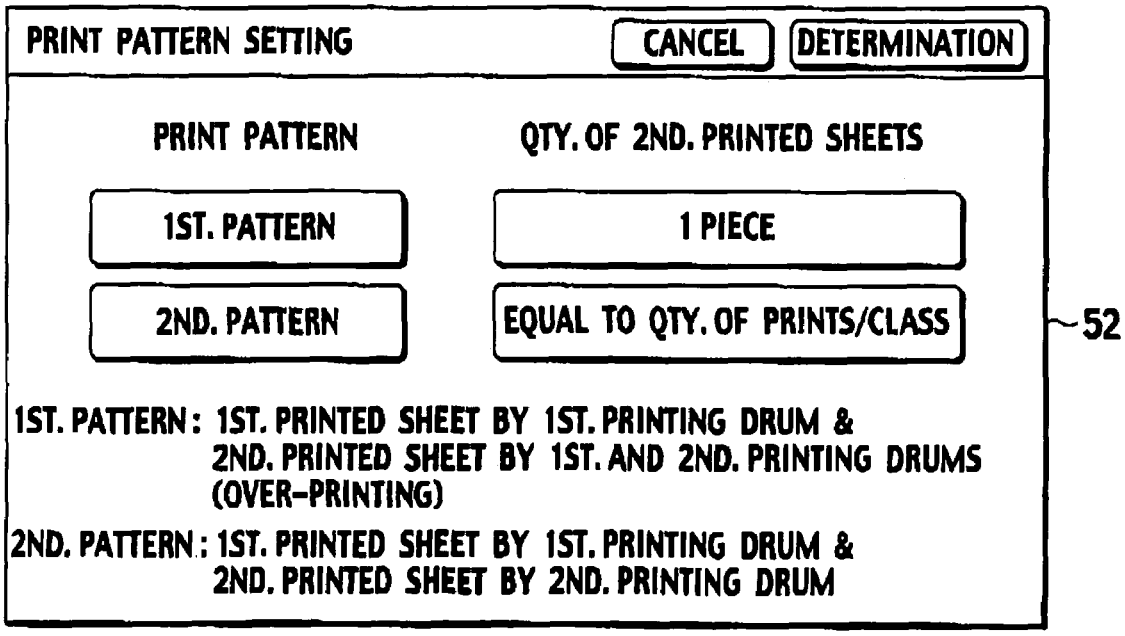
FIG. 6 is a typical view showing group printing setting information in tabular form of the embodiment of the present invention.
FIG. 7 is a view showing an example of a printing pattern setting information stored in a group-printing setting storage unit of FIG. 2.

In step S01, the user firstly inputs the number (Qty.) of classes for each group and the number (Qty.) of sheets per one class in accordance with the setting screen for group printing of FIG. 5. On completion of input, the user manipulates a decision button for establishment. Then, the controller 49 stores established information as the class-printing setting information in the group-printing setting storage unit 53. FIG. 6 illustrates the established class-printing setting information in the form of a table. In the table, the number of classes and the number of printed sheets about a group (or groups) with no information by a user are set to 0, respectively. Next, the user manipulates the pattern setting button 54 to open a pattern setting screen of FIG. 7, selects a print pattern and the number (Qty.) of second printed sheets for each group and manipulates a decision button for establishment. The controller 49 stores the established information as the print-pattern setting information and the quantity setting information about the second printed sheets, into the group-printing setting storage unit 53.

According to the embodiment, with the use of the first printing drum 25 covered with the first stencil sheet 12 having a perforated image of a first color ink and the second printing drum 36 covered with the second stencil sheet 12 having a perforated image of a second color ink, a user can select either a first pattern or a second pattern, as shown in FIG. 7. Note that, according to the first pattern, first printed sheets printed by the first printing drum 25 and second printed sheets over-printed by the first printing drum 25 and the second printing drum 36 are produced with respect to each group. While, according to the second pattern, first printed sheets printed by the first printing drum 25 and second printed sheet(s) printed by the second printing drum 36 are printed with respect to each group.

In addition, the numbers of the above printing patterns are determined by the formula (1) with k=2 as follows:

$$\prod_{i=2}^{2}\left(\sum_{j=0}^{i-1} {}_{i-1}C_j\right) = \sum_{j=0}^{1} {}_1C_j = {}_1C_0 + {}_1C_1 = 2.$$

As for the number (Qty.) of second printed sheet(s), a user can select either one or the quantity (X) of sheets per one class.

In step S02, the controller 49 operates to perforate the first and second stencil sheets 12, 12 in heat (make stencils) on the basis of one image data obtained by the original read-out unit 19 reading out first and second originals or another image data obtained by the original read-out unit 19 reading out a multicolor original and further separated in accordance with designated color inks. Successively, the controller 49 operates to wind the finished first and second stencil sheets 12, 12 around the first printing drum 25 and the second printing drum 36 respectively (stencil making operation). Details of the stencil making operation will be described later.

In step S03, the controller 49 controls the operation of the stencil printing machine 1 in accordance with the class-printing setting information, the print-pattern setting information and the quantity setting information about the second printed sheets all stored in the group-printing setting storage unit 53, accomplishing the printing operation. Details of the printing operation will be described later.

Then, corresponding to a completion of the printing operation, a series of group printing operation is finished.

[Making Stencils]

Next, the operation of the controller 49 in making the stencils will be described with reference to a flow chart of FIG. 8.

Figure 8:
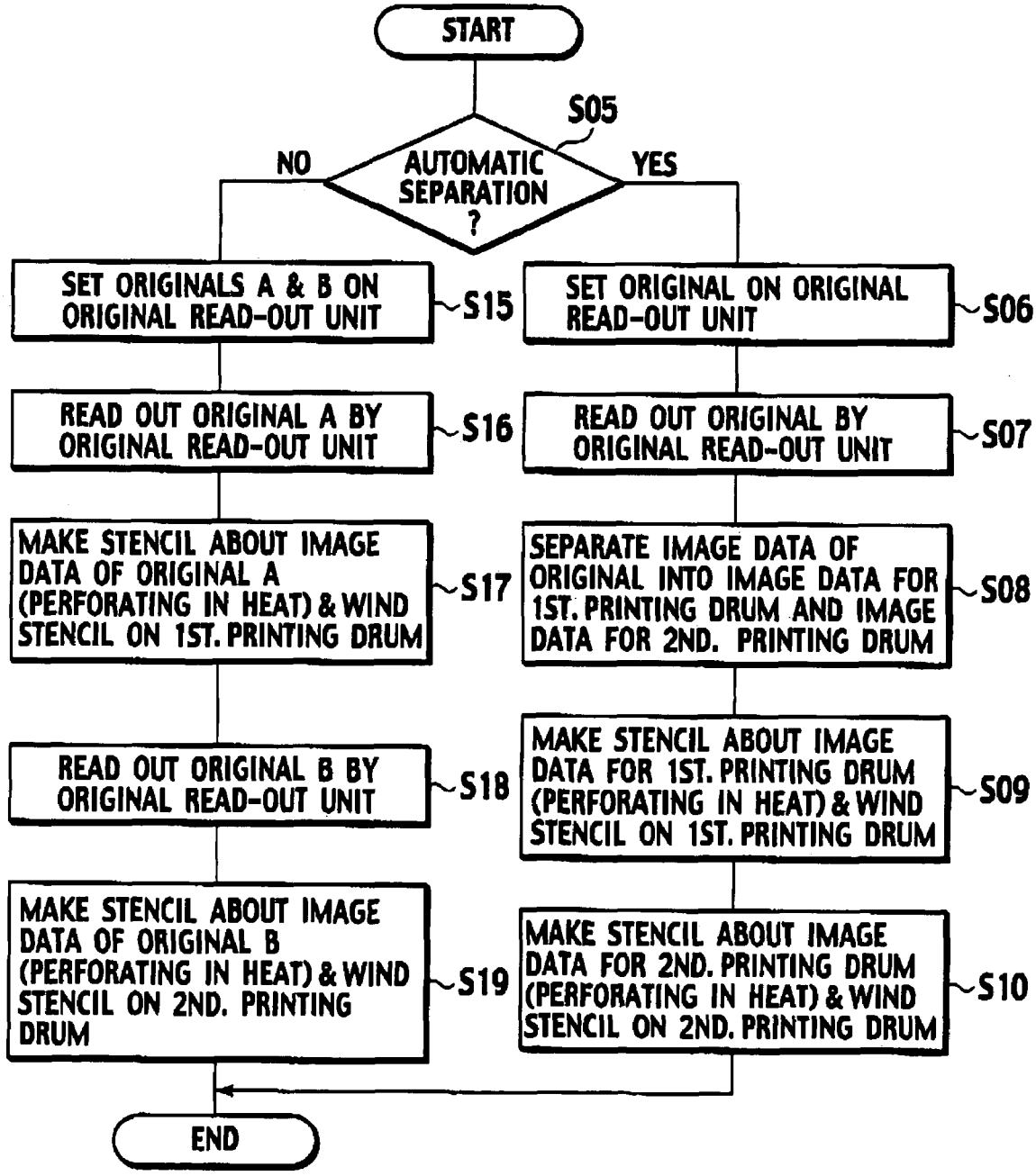
FIG. 8 is a flow chart showing a subroutine of a stencil making operation of FIG. 3.

The operation in accordance with the flow chart of FIG. 8 is started when the process at step S01 of FIG. 3 is completed.

In step S05, the controller 49 judges whether an automatic separation mode where one multicolor original image is divided into two-color images in charge of the first printing drum 25 and the second printing drum 36 is being selected or not. If the automatic separation mode is not selected, then the controller 49 makes the routine go to step S15. If the automatic separation mode is selected, then the controller 49 makes the routine go to step S06.

In step S06, the controller 49 operates to display a command to set the multicolor original on the original read-out unit 19 on the liquid crystal touch panel (not shown). Based on the command, a user lays the multicolor original on the original read-out unit 19 and designates color inks for printing of the multicolor original to be divided into the image data printed by the first printing drum 25 and the image data printed by the second printing drum 36 by means of the liquid crystal touch panel. Then, the controller 49 makes the routine go to step S07 in response to a user's manipulation of stencil-making keys (not shown) of the operation panel 52 after setting the multicolor original on the original read-out unit 19.

In step S07, the controller 49 controls the original read-out unit 19 so as to read out the multicolor original thereon. After completing the reading-out operation of the original read-out unit 19, the routine goes to step S08.

In step S08, the controller 49 operates to divide the read-out image data of the multicolor original into the image data to be printed by the first printing drum 25 and the image data to be printed by the second printing drum 36 according to the color inks designated by the user (separation process). After that, the routine goes to step S09.

In step S09, the controller 49 controls the stencil printing machine 1 so that the first stencil sheet 12 is perforated in heat on the basis of the image data for the first printing drum 25 and subsequently wound around the same drum 25. Then, the controller 49 makes the routine go to step S10.

In step S10, the controller 49 controls the stencil printing machine 1 so that the second stencil sheet is perforated in heat on the basis of the image data for the second printing drum 36 and subsequently wound around the same drum 36, completing the operation.

On the other hand, when it is judged in step S05 that the automatic separation mode is not being selected, the routine goes to step S15. In step S15, the controller 49 operates to display a command to set one original A for the first printing drum 25 and another original B for the second printing drum 36 in piles on the original read-out unit 19, on the liquid crystal touch panel (not shown) of the operation panel 52. Receiving the command, the user lays the originals A, B in piles on the original read-out unit 19 and indicates a starting of making stencils through the stencil-making keys (not shown) of the operation panel 52.

In step S16, the controller 49 controls the original read-out unit 19 so as to read out an image of the original A thereon. After completing the reading-out operation of the original read-out unit 19, the routine goes to step S17.

In step S17, the controller 49 controls the stencil printing machine 1 so that the first stencil sheet 12 is perforated in heat on the basis of the read-out image data and subsequently wound around the first printing drum 25. After winding the first stencil sheet 12 around the first printing drum 25, the controller 49 makes the routine go to step S18.

In step S18, the controller 49 controls the original read-out unit 19 so as to read out an image of the original B thereon. After completing the reading-out operation of the original read-out unit 19, the routine goes to step S19.

In step S19, the controller 49 controls the stencil printing machine 1 so that the second stencil sheet 12 is perforated in heat on the basis of the read-out image data and subsequently wound around the second printing drum 36. In this way, a series of stencil making operation is ended.

[Printing]

Next, the operation of the controller 49 in performing the printing operation will be described with reference to a flow chart of FIG. 9.

Figure 9:
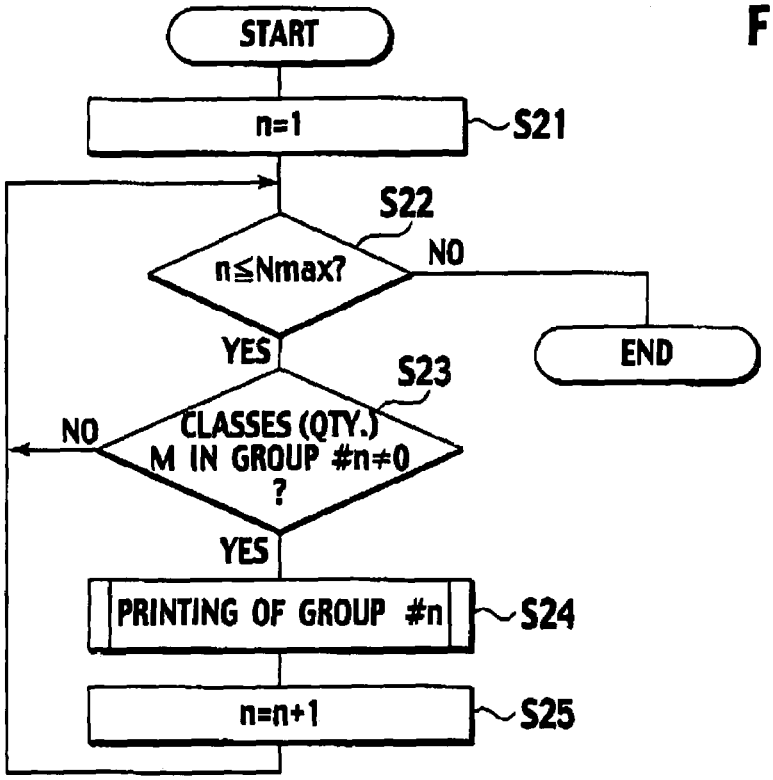
FIG. 9 is a flow chart showing a subroutine of a printing operation of FIG. 3.

The operation in accordance with the flow chart of FIG. 9 is started when the process in step S02 of FIG. 3 is completed.

In step S21, the controller 49 sets a value n of a program counter for counting a group number N of the class-printing setting information (see FIG. 6) stored in the group-printing setting information storage unit 53 up as 1 (i.e. n=1) and further makes the routine goes to step S22.

In step S22, the controller 49 judges whether or not the value n of the program counter is equal to or less than a maximum value Nmax (e.g. Nmax=50 in case of FIG. 6) for the group number N. If the value n of the program counter is neither equal to nor less than the maximum value Nmax, then the controller 49 judges that the printing processes of all of the groups have been already completed and further terminates the printing operation. While, if the value n of the program counter is equal to or less than the maximum value Nmax, then the controller 49 makes the routine (printing process) go to step S23.

In step S23, the controller 49 judges whether the number of classes M in an $n^{th}$. group (group [n]) is zero or not while referring to the class-printing setting information stored in the group-printing setting storage unit 53. If it is judged that the number of classes M in the $n^{th}$ group is zero, then the controller 49 returns the routine to step S22. While, if it is judged that the number of classes M in the $n^{th}$. group is not zero, then the controller 49 makes the routine go to step S24.

In step S24, the controller 49 controls the operation of the stencil printing machine 1 so as to print first printed sheets and second printed sheets in the $n^{th}$. group with respect to each class collectively (i.e. execution of the group-printing operation). In succession, the controller 49 makes the routine go to step S25. In connection, details of the operation of the controller 49 in performing the group-printing operation will be described with reference to a flow chart of FIG. 10.

In step S25, the controller 49 increases the value n of the program counter by one increment (i.e. n=n+1) and returns the routine to step S22. Subsequently, the above-mentioned processes from steps S22 to S25 will be repeated until a judgment "No" at step S22.

[Group Printing]

Next, the operation of the controller 49 in performing the group printing operation will be described with reference to the flow chart of FIG. 10.

Figure 10:
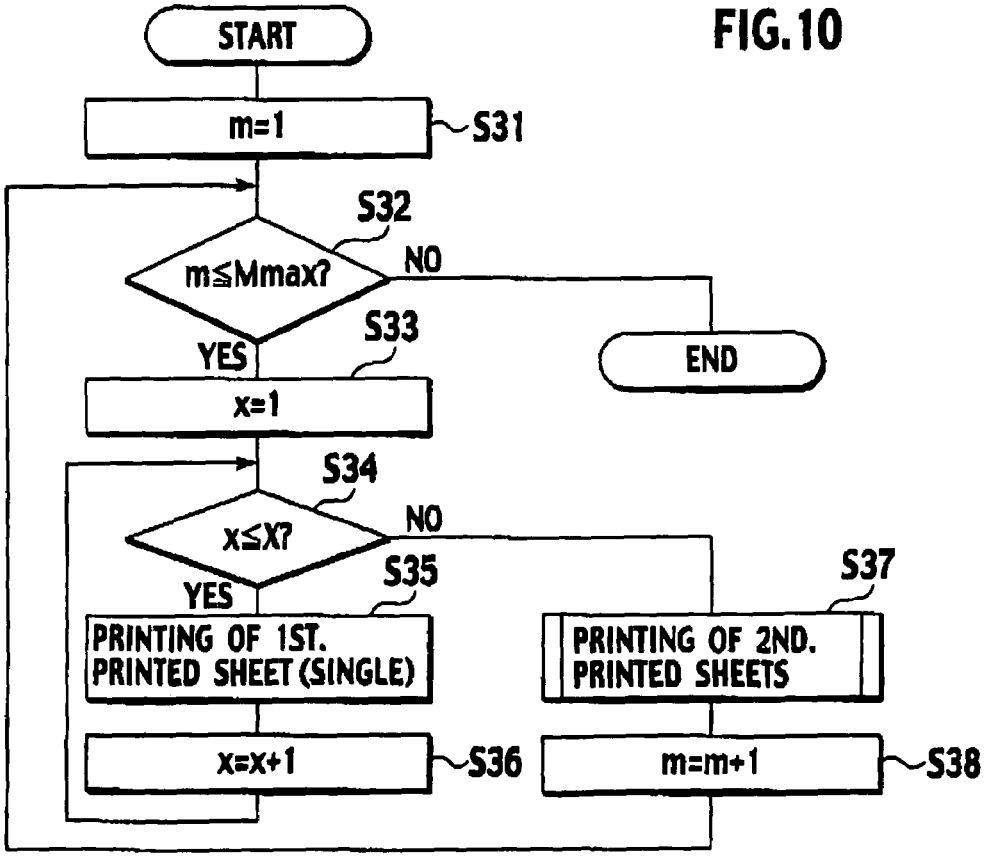
FIG. 10 is a flow chart showing a subroutine of a group-printing operation of FIG. 9.

The operation in accordance with the flow chart of FIG. 10 is started when it is judged that the number of classes M in the $n^{th}$. group is not 0 (zero) in step S23 of FIG. 9.

In step S31, the controller 49 sets a value m of a program counter for counting the number of classes in which the printing of the first printed sheets has been completed, up as 1 (i.e. m=1) and further makes the routine goes to step S32.

In step S32, the controller 49 judges whether or not the value m of the program counter in the $n^{th}$. group is equal to or less than a maximum number of classes Mmax. If the value m of the program counter is neither equal to nor less than the maximum number Mmax, then the controller 49 judges that the printing processes of the first and second printed sheets have been already completed in all of the classes in the $n^{th}$. group and further terminates a series of group printing operation. While, if the value m of the program counter is equal to or less than the number Mmax, then the controller 49 makes the routine (printing process) go to step S33.

In step S33, the controller 49 sets a value x of a program counter for counting the number (Qty.) of the first printed sheets in an $m^{th}$. class of the $n^{th}$. group up as 1 (i.e. x=1) and further makes the routine goes to step S34.

In step S34, the controller 49 reads out an established number X of the first printed sheets in the $m^{th}$. class of the $n^{th}$. group while referring to the class-printing setting information stored in the group-printing setting storage unit 53 and judges whether the value x of the program counter is equal to or less than a predetermined number (Qty.) X of sheets. If the value x of the program counter is neither equal to nor less than the predetermined number X, then the controller 49 judges that the printing processes for the first printed sheets in the $m^{th}$. class have been already completed and further makes the routine go to step S37. While, if the value x of the program counter is equal to or less than the predetermined number X, then the controller 49 makes the routine (printing process) go to step S35.

In step S35, the controller 49 controls the operations of the first printer 4 and the second printer 6 (i.e. printing by the first printing drum 25 and non-printing by the second printing drum 36) so as to produce a piece of the first printed sheet and makes the routine go to step S36.

In step S36, the controller 49 increases the value x of the program counter by one increment (i.e. x=x+1) and returns the routine to step S32.

On the other hand, if the judgment in step S34 is "No", that is, when the value x of the program counter is neither equal to nor less than the predetermined number X, the routine goes to step S37 where the controller 49 controls the operations of the first printer 4 and the second printer 6 so as to produce the second printed sheets by either the first and second printing drums 25, 36 (over-printing) or the second printing drum 36 only (i.e. the printing operation for the second printed sheets). After completing the printing operation, the controller 49 makes the routine go to step S38. In connection, details of the operation of the controller 49 in performing the printing operation for the second printed sheets will be described with reference to a flow chart of FIG. 11.

In step S38, the controller 49 increases the value m of the program counter by one increment (i.e. m=m+1) and returns the routine to step S32. Subsequently, the above-mentioned processes from steps S32 to S37 will be repeated until a judgment "No" at step S32.

[Printing of $2^{nd}$. Printed Sheets]

Next, the operation of the controller 49 in performing the printing operation of the second printed sheets will be described with reference to the flow chart of FIG. 11.

Figure 11:
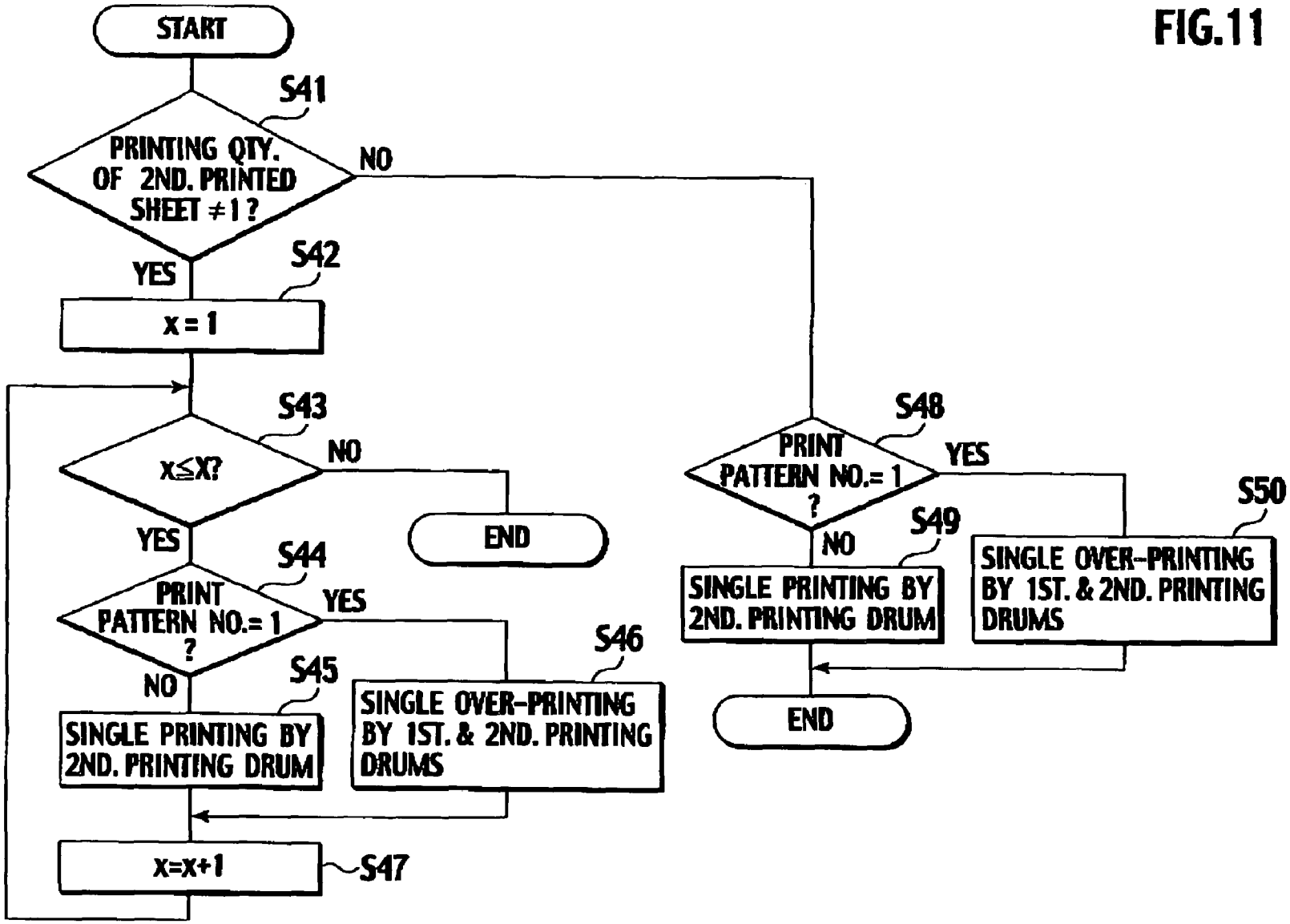
FIG. 11 is a flow chart showing a subroutine of a printing operation for printing a second printed sheet of FIG. 10.

The operation in accordance with the flow chart of FIG. 11 is started when it is judged that the value x of the program counter is neither equal to nor less than the predetermined number X at step S34 of FIG. 10.

In step S41, the controller 49 judges whether the number (Qty.) of the second printed sheet on establishment is one or not while referring to the quantity setting information about the second printed sheets stored in the group-printing setting storage unit 53. If it is judged that the number (Qty.) of the second printed sheet is not one, in other words, when the number of second printed sheet is equal to the number of printed sheets per one class, then the controller 49 makes the routine go to step S42. While, if the number of the second printed sheet is one, then the controller 49 makes the routine go to step S48.

In step S42, the controller 49 sets a value x of a program counter for counting the number (Qty.) of second printed sheets in the $m^{th}$. class of the $n^{th}$. group up as 1 (i.e. x=1) and further makes the routine goes to step S43.

In step S43, the controller 49 reads out a predetermined number (Qty.) X of the second printed sheets in each class of the $n^{th}$. group while referring to the class-printing setting information stored in the group-printing setting storage unit 53 and judges whether the value x of the program counter is equal to or less than the number X of second printed sheets or not. If the value x of the program counter is neither equal to nor less than the predetermined number X, then the controller 49 judges that the printing processes for the second printed sheets in the $m^{th}$. class have been already completed, so that the routine is ended. While, if the value x of the program counter is equal to or less than the predetermined number X, then the controller 49 makes the routine go to step S44.

In step S44, the controller 49 judges whether a print pattern on establishment is identical to a first pattern or not while referring to the print-pattern setting information stored in the group-printing setting storage unit 53. If it is judged that the established print pattern is not the first pattern, namely, an establishment of a second pattern, then the controller 49 makes the routine go to step S45. While, if it is judged that the established print pattern is identical to the first pattern, then the controller 49 makes the routine go to step S46.

In step S45, the controller 49 controls the operations of the first printer 4 and the second printer 6 (i.e. non-printing by the first printing drum 25 and printing by the second printing drum 36) so as to produce a piece of the second printed sheet and makes the routine go to step S47.

Meanwhile, if it is judged that the established print pattern is the first pattern in step S44, the controller 49 controls the operations of the first printer 4 and the second printer 6 so as to produce a piece of the second printed sheet by over-printing with the use of the first and second printing drums 25, 36 in step S46. Thereafter, the routine goes to step S47.

In step S47, the controller 49 increases the value x of the program counter by one increment (i.e. x=x+1) and returns the routine to step S43.

Returning to step S41, if it is judged that the number (Qty.) of the second printed sheet on establishment is one, then the routine goes to step S48 where it is judged whether the print pattern on establishment is identical to the first pattern or not while referring to the print-pattern setting information stored in the group-printing setting storage unit 53. In step S48, if it is judged that the established print pattern is not the first pattern, namely, an establishment of the second pattern, then the controller 49 makes the routine go to step S49. While, if it is judged that the established print pattern is identical to the first pattern, then the controller 49 makes the routine go to step S50.

In step S49, the controller 49 controls the operations of the first printer 4 and the second printer 6 (i.e. non-printing by the first printing drum 25 and printing by the second printing drum 36) so as to produce a piece of the second printed sheet and successively, a series of printing operation of the second printed sheets is completed.

Meanwhile, if it is judged that the established print pattern is the first pattern in step S48, the controller 49 controls the operations of the first printer 4 and the second printer 6 so as to produce a piece of the second printed sheet by over-printing with the use of the first and second printing drums 25, 36 in step S50. Subsequently, a series of printing operation of the second printed sheets is completed.

As evidenced by the above descriptions, the controller 49 of the so stencil printing machine 1 of the present embodiment operates to wind the first and second stencil sheets 12, 12 having the first and second images perforated therein around the first printing drum 25 and the second printing drum 36, respectively. The controller 49 further controls the first printer 4 and the second printer 6 so as to perform the printing operation where the first printing drum 25 prints the first printed sheets by a required number per one class and thereafter, either the second printing drum 36 only or the first and second printing drums 25, 36 print the second printed sheets by one or the required number. Such a printing operation is carried out with respect to each class.

Figure 12A:
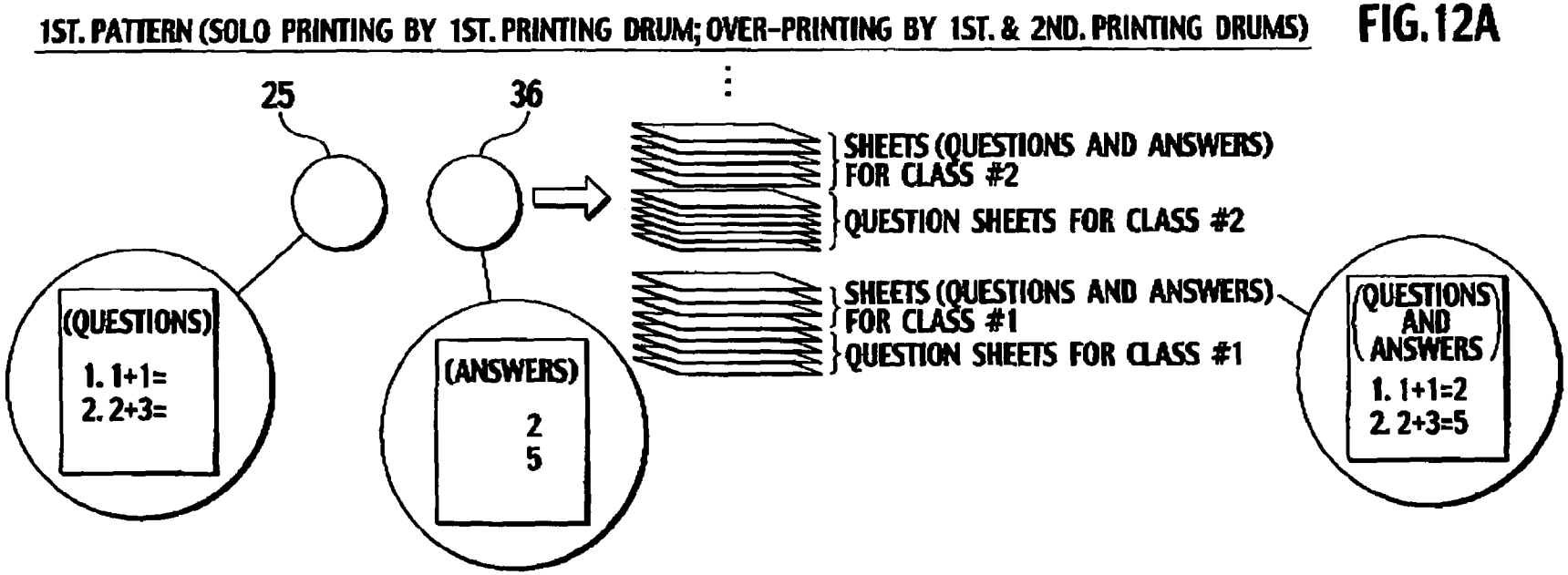
FIGS. 12A and 12B are typical views explaining concrete embodiments of the present invention.
Figure 12B:
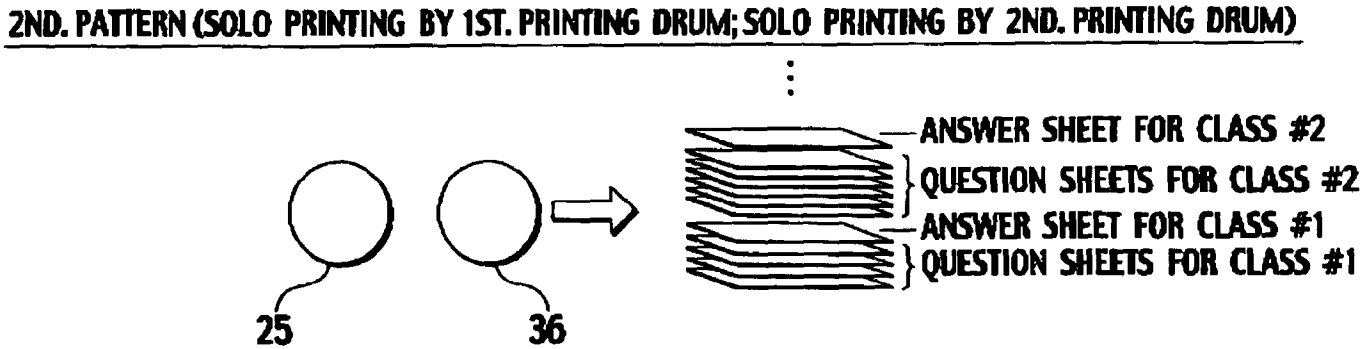

As concrete examples, FIGS. 12A and 12B commonly illustrate cases of printing question sheets as the first printed sheets and answer sheets as the second printed sheets. In these figures, FIG. 12A explains one situation that: the first printing drum 25 is covered with a first stencil sheet 12 having a question image performed therein; the second printing drum 36 is covered with a second stencil sheet 12 having an answer image performed therein; a first pattern is adopted as the print pattern; the number of second printed sheets is equal to the number of first printed sheets; and the question sheets having questions printed thereon and the answer sheets having both the questions and their answers printed thereon are printed by the number of pupils forming one class, wherein such a printing operation is carried out with respect to each class. On the other hand, FIG. 12B explains another situation that: the first printing drum 25 is covered with a first stencil sheet 12 having a question image performed therein; the second printing drum 36 is covered with a second stencil sheet 12 having an answer image performed therein; a second pattern is adopted as the print pattern; the number of second printed sheet is set to one; and the question sheets having questions printed thereon are printed by the number of pupils forming one class while a single answer sheet (for a teacher) having answers to the questions printed thereon is printed, wherein such a printing operation is also carried out with respect to each class.

Note that the present invention is not limited to the above-mentioned embodiment only.

For instance, although the above-mentioned embodiment is explained with a stencil printing machine having two printing drums, the present invention is applicable for a stencil printing machine having k numbers of printing drums, which are any natural number more than 3. For example, when the present invention adopts a stencil printing machine having three printing drums, the following eight printing patterns are set up:

(1) Printing pattern 1: a first printed sheet obtained by using only a first printing drum+a second printed sheet obtained by using only a second printing drum+a third printed sheet obtained by using only a third printing drum;

(2) Printing pattern 2: a first printed sheet obtained by using only the first printing drum+a second printed sheet obtained by using only the second printing drum+a third printed sheet obtained by using the first and third printing drums;

(3) Printing pattern 3: a first printed sheet obtained by using only the first printing drum+a second printed sheet obtained by using only the second printing drum+a third printed sheet obtained by using the second and third printing drums;

(4) Printing pattern 4: a first printed sheet obtained by using only the first printing drum+a second printed sheet obtained by using only the second printing drum+a third printed sheet obtained by using the first, second, and third printing drums;

(5) Printing pattern 5: a first printed sheet obtained by using only the first printing drum+a second printed sheet obtained by using the first and second printing drums+a third printed sheet obtained by using only the third printing drum;

(6) Printing pattern 6: a first printed sheet obtained by using only the first printing drum+a second printed sheet obtained by using the first and second printing drums+a third printed sheet obtained by using the second and third printing drums;

(7) Printing pattern 7: a first printed sheet obtained by using only the first printing drum+a second printed sheet obtained by using the first and second printing drums+a third printed sheet obtained by using the first and third printing drums:

(8) Printing pattern 8: a first printed sheet obtained by using only the first printing drum+a second printed sheet obtained by using the first and second printing drums+a third printed sheet obtained by using the first, second, and third printing drums.

These eight printing patterns are calculated by the formula (1) with k=3 as follows:

$$\prod_{i=2}^{3}\left(\sum_{j=0}^{i-1} {}_{i-1}C_j\right)=\left(\sum_{j=0}^{2-1} {}_{2-1}C_j\right)\times\left(\sum_{j=0}^{3-1} {}_{3-1}C_j\right)$$
$$=\left(\sum_{j=0}^{1} {}_{1}C_j\right)\times\left(\sum_{j=0}^{2} {}_{2}C_j\right)$$
$$=({}_1C_0+{}_1C_1)\times({}_2C_0+{}_2C_1+{}_2C_2)=2\times 4=8.$$

In this case, the eight printing patterns are displayed on the printing pattern setting screen shown in FIG. 7, and setting buttons setting the numbers of the printing sheets from the second printing pattern to the eight printing pattern. Then, there are several methods of setting a printing pattern from among the eight printing patterns. For example, a given pattern of the eight printing patterns may be preliminarily set up on the stencil printing machine. Alternatively, the operation panel 52 allows a user to provide the eight printing patterns and then to select a desired printing pattern from among the provided eight printing patterns on the operation panel 52. Also, when the user select the desired printing pattern, the operation panel 52 allows the user to input user identifying information. Then, the controller 49 counts up numbers of user's selection of a printing pattern with respect to each user identifying information. In this situation, when counting numbers of a printing pattern reach a threshold value and further user identifying information corresponding to the counting number is input to the operational panel 52, the controller 49 is allowed to automatically sets up the printing pattern. Here the threshold value may take a value, depending on a combination of a printing pattern and user identifying information or only user identifying information, as well as a constant value.

As described above, the printing patterns of the present invention include the number of printed sheets same as that of printing drums, and the number is determined by the formula (1).

Additionally, a given printing pattern of the plurality of printing patterns in the above-described embodiment In addition, although the above-mentioned embodiment adopts the question sheets as the first printed sheets and the answer sheets as the second printed sheets and establishes the number of second printed sheets being equal to the number of first printed sheets or a single sheet, the number of second printed sheets may be optionally established on condition that a button for selecting the number of second printed sheets (e.g. "option" button) is incorporated in the print pattern setting image shown in FIG. 7. Then, for instance, it becomes possible to print first printed sheets to be delivered to all of houses in a town and second printed sheets to be circularized with respect to each group compartmentalizing the houses, in units of residents' association.

That is, it will be understood by those skilled in the art that the foregoing descriptions are nothing but embodiments and various modifications of the disclosed stencil printing machine and its control method and therefore, various changes and modifications may be made within the scope of claims.

The entire content of Japanese Patent Application No. P2004-342530 with a filing data of Nov. 26, 2004 is herein incorporated by reference.

What is claimed is:

1. A stencil printing machine having first and second printing drums, which makes first and second stencil sheets based on original images, winds the first and second stencil sheets around the first and second printing drums respectively, and presses print sheets on the first and second printing drums to print the original images onto the print sheets, the stencil printing machine comprising:

an operator for allowing a user to input a first number of print sheets consisting of first printed sheets and a second number of print sheets consisting of second printed sheets with respect to each group;

a group-printing setting information storage unit for storing the first number of print sheets and the second number of print sheets with respect to each group inputted by the operator; and a controller configured to control an operation of the stencil printing machine so as to perform a printing operation of firstly allowing the first printing drum to print the first printed sheets by the first number of print sheets stored in the group-printing setting information storage unit and subsequently allowing either the second printing drum only or the first and second printing drums to print the second printed sheets by the second number of print sheets stored in the group-printing setting information storage unit, wherein the printing operation is carried out with respect to each group.

2. The stencil printing machine of claim 1, wherein the operator is configured so as to enable a user to set the second number for the second printed sheets by an optional number.

3. A method of controlling a stencil printing machine having first and second printing drums, which makes first and second stencil sheets based on original images, winds the first and second stencil sheets around the first and second printing drums respectively, and presses print sheets on the first and second printing drums to print the original images onto the print sheets, the method comprising the steps of:

storing a first number of print sheets consisting of first printed sheets and a second number consisting of second printed sheets with respect to each group;

performing a printing operation of firstly allowing the first printing drum to print the first printed sheets by the first number of print sheets and subsequently allowing either the second printing drum only or the first and second printing drums to print the second printed sheets by the second number of print sheets wherein the printing operation is carried out with respect to each group.

4. A stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising:

an operator for allowing a user to input a first number of print sheets to a k-th number of print sheets, each of which corresponds to k kinds of printed sheets included in a given printing pattern of $$\prod_{i=2}^{k}\left(\sum_{j=0}^{i-1} {}_{i-1}C_j\right)$$

kinds of printing patterns with respect to each group;

a group-printing setting information storage unit for storing the first number of print sheets to the k-th number of print sheets with respect to each group inputted by the operator; and a controller for controlling printing drums, that are required to generate the given printing pattern, of the k numbers of printing drums, and printing the k kinds of printed sheets included in the given printing pattern by the first number of print sheets to the k-th number of print sheets stored in the group-printing setting information storage unit, wherein the printing operation is carried out with respect to each group.

5. A method of controlling a stencil printing machine having k numbers of printing drums, which makes k numbers of stencil sheets based on original images, winds the k numbers of stencil sheets around the k numbers of printing drums respectively, and presses print sheets on the k numbers of printing drums to print the original images onto the print sheets, the stencil printing machine comprising:

allowing the user to input a first number of print sheets to a k-th number of print sheets, each of which corresponds to k kinds of printed sheets included in a given printing pattern of $$\prod_{i=2}^{k}\left(\sum_{j=0}^{i-1} {}_{i-1}C_j\right)$$

kinds of printing patterns with respect to each group;

storing the first number of print sheets to the k-th number of print sheets with respect to each group inputted by the operator;

controlling printing drums, that are required to generate the given printing pattern, of the k numbers of printing drums; and printing the k kinds of printed sheets included in the given printing pattern by the first number of print sheets to the k-th number of print sheets, wherein the printing operation is carried out with respect to each group.

* * * * *